United States Patent [19]

Fleissner

[11] Patent Number: 4,574,668

[45] Date of Patent: Mar. 11, 1986

[54] APPARATUS FOR CUTTING RIBBON- OR CORD-LIKE MATERIAL

[75] Inventor: Heinz Fleissner, Riehen, Switzerland

[73] Assignee: Vepa Aktiengesellschaft, Switzerland

[21] Appl. No.: 542,183

[22] Filed: Oct. 14, 1983

[30] Foreign Application Priority Data

Sep. 3, 1983 [DE] Fed. Rep. of Germany ..... 3331924

[51] Int. Cl.[4] ..... D01G 1/04

[52] U.S. Cl. ..... 83/346; 83/913

[58] Field of Search ..... 83/347, 346, 913; 19/16

[56] References Cited

U.S. PATENT DOCUMENTS 3,485,120 12/1969 Keith ..... 83/913 X 4,300,422 11/1981 Potter ..... 83/913 X 4,345,355 8/1982 Berchoux et al. ..... 83/913 X

*Primary Examiner*—Frank T. Yost

*Attorney, Agent, or Firm*—Antonelli, Terry & Wands

[57] ABSTRACT

The invention relates to an apparatus for cutting synthetic fiber yarns into staple fibers, for which purpose the yarn is wound several times around a knife cage and rests on blades oriented radially outwardly with their cutting edges and is urged from the outside radially inwardly against these blades by means of a contact roller. The blades are held in two blade-supporting disks arranged at a mutual spacing in superimposed relationship. In order to guide the cut staple fibers radially inwardly behind the blades, and for connecting the two blade-supporting disks with each other, approximately radially oriented partitions are provided directly adjoining several of the backs of the knives, these partitions extending at least in part over the height of the knife cage along the staple fiber discharge chamber in the center of the knife cage.

15 Claims, 4 Drawing Figures

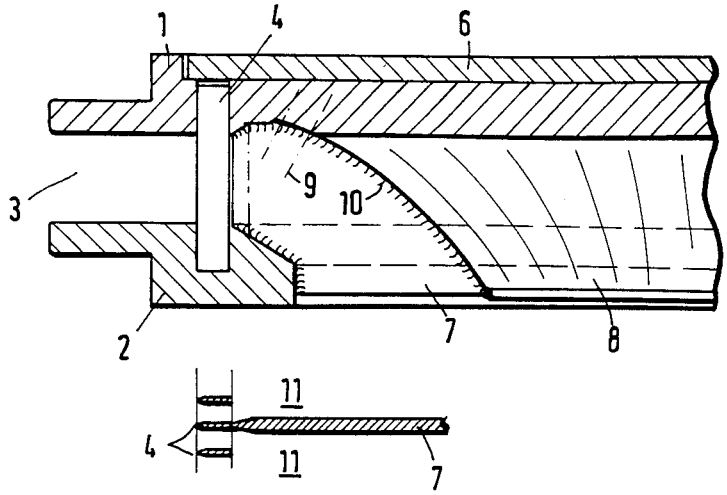
Fig. 1a
Fig. 1b
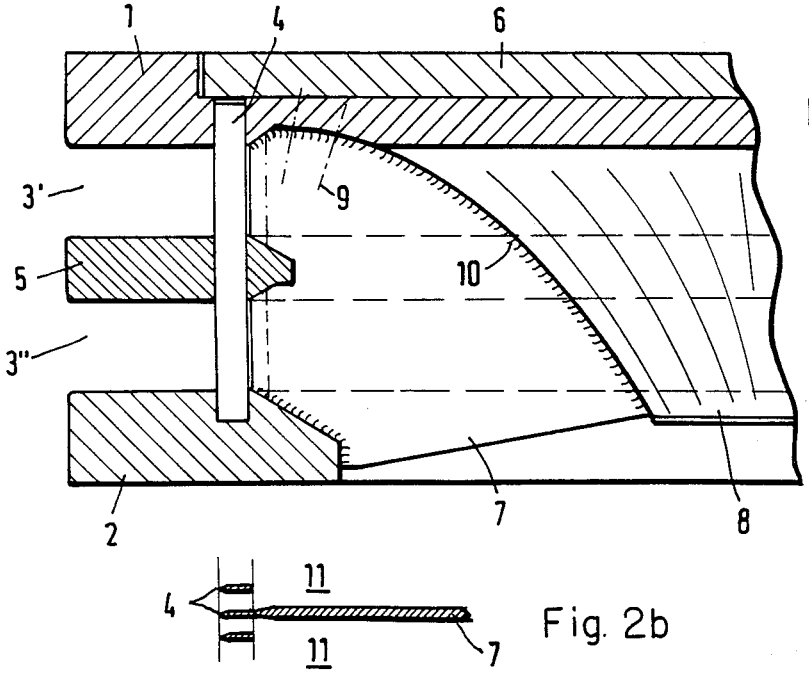
Fig. 2a
Fig. 2b

APPARATUS FOR CUTTING RIBBON- OR CORD-LIKE MATERIAL

This invention relates to an apparatus for cutting ribbon- or cord-like material, especially for the production of staple fibers from synthetic fiber cables or yarns, with a knife cage around which the cable is wound several times with at least two blade-supporting disks arranged axially one above the other and at a spacing of approximately the knife length by means of spacer elements provided in a radially inwardly oriented position, a plurality of blades oriented radially outwardly with their cutting edges being held at a spacing corresponding to the desired staple fiber length between the disks, and the knife cage being associated on the outside at a spacing with a contact roll for providing the radially inwardly acting cutting pressure on the wound-up cable.

An apparatus of this type is known from DOS [German Unexamined Laid-Open Application] No. 2,609,420. In this reference, the spacer elements for the blade-supporting disks are several blade holders distributed over the circumference and fashioned as fixed rods. The fixed rods, holding the blade-supporting disks at a spacing and being circular in cross section exhibit a slot oriented radially toward the outside, the associated knife being inserted therein with its back, while the additional blades required between these fixed rods for producing the staple fibers are arranged in a readily exchangeable fashion in the knife cage without rearward reinforcement. An easy variation of the cutting lengths is thus made possible.

Another embodiment of the apparatus of this type is disclosed in DOS No. 2,350,540 or, for two directly superimposed knife cages, see DOS No. 3,203,083 wherein the uppermost blade-supporting disk in the center of the knife cage exhibits spokes individually distributed uniformly over the circumference, holding the blade-supporting disk or disks arranged therebelow at a spacing from the upper blade-supporting disk. On account of this spoke construction, it is unnecessary to provide fixed rods as knife back reinforcements in connection with the strength of the knife cage so that any staple fiber lengths can be cut by the respective association of the blades in the knife cage.

It has been found under practical conditions that especially in case of staple lengths around 12 mm the radially inwardly directed spokes greatly impede the continuous discharge flow of the cut synthetic fibers. The adjoining staple parcels are telescoped into one another, which is tantamount to matting of the staple fibers, and they then no longer divide at the spokes. In this situation, the known construction with the fixed rods is of no help, either, namely because the discharge flow of the cut fibers is impeded by these backs or the knives.

The invention is based on the object of further developing an apparatus of the type discussed hereinabove in such a way that there is no inhibition whatsoever of the continuous staple fiber discharge from the knife cage. In particular, this construction is to ensure and, if at all possible, improve the ruggedness of the knife cage in total.

In order to attain the thus-posed object, the invention provides that approximately radially oriented partitions are arranged in the interior of the knife cage radially inwardly behind the blades. In this connection, it is advantageous for the partitions to directly adjoin the knife backs and to taper conically down to the blade thickness on the edge adjoining the associated blade. These partitions guide the cut fibers into the interior of the knife cage without damming up being possible at that location due to a posed resistance. Therefore, at least in this zone, the adjacent staple fibers no longer are pushed into each other so that the matting, which here is disadvantageous, is prevented.

It is especially expedient to mount the partitions on the upper as well as lower blade-supporting disks so that the partitions are responsible not only for guiding the cut fibers, but also for the mutual arrangement of the blade-supporting disks. Thus, the partitions also serve as spacer means.

For this purpose, three or more partitions should be uniformly distributed over the circumference of the knife cage, and these partitions should simultaneously serve as the connecting bearing element for the superimposed blade-supporting disks. The partitions are only slightly thicker than the knife backs since, due to their length extending approximately up into the height of the underside of the lower blade-supporting disks, these partitions exhibit an adequately long longitudinal edge engaging, on the one hand, at the upper blade-supporting disk and, on the other hand, at the lower blade-supporting disk. On account of this mounting of the spaced-apart blade-supporting disks, which in this arrangement is very rugged, the entire construction can be built more lightweight without the knife cage losing in strength; on the contrary, due to these partitions, the ruggedness is considerably enhanced as compared with the construction with the fixed rods fashioned as blade reinforcements, or the radially inwardly oriented spokes.

In order to furthermore favorably affect the uniform guidance of the cut fibers, the invention provides in one embodiment to join the partitions with one another by means of an internal baffle in the center of the knife cage, oriented perpendicularly to the partitions. Thus, between the partitions, respectively one separate staple fiber discharge duct is formed wherein an influence on the discharge flow velocity by the neighboring flow duct is prevented. In this connection, the conventional displacement element, arranged in the center of the knife cage, as disclosed by DOS No. 2,408,258 should be mentioned, provided in this reference for preventing plait formation of the staple fibers discharged all around. In contrast thereto, here an annular knife back chamber is formed by this cylinder, together with the inner peripheral surface of the lower knife cage, within the knife cage, the partitions extending transversely therethrough. In this connection, it is advantageous to have the cylinder flare radially at the top, forming by itself a funnel on the inner surface which here is not being utilized.

The drawing shows two embodiments of the apparatus according to this invention. Still further details of this invention will be described below with reference thereto. In the drawing:

FIG. 1*a* is a partial cross-sectional view of a knife cage construction with two superimposed blade-supporting disks;

FIG. 1*b* is a partial top sectional view of a partition at right angles to the plane of FIG. 1*a*, positioned directly therebelow;

FIG. 2*a* shows a knife cage construction with three superimposed blade-supporting disks; and FIG. 2*b* is a partial top sectional view of a partition at right angles to the plane of FIG. 2*a*, positioned directly therebelow.

The knife cage illustrated in FIGS. 1*a* and 2*a* consists of an upper blade-supporting disk 1 and a lower blade-supporting disk 2. These disks are arranged at a mutual spacing and leave therebetween a vacant annular chamber 3 exhibiting, at its inner portion, blades 4 oriented radially outwardly with the cutting edges. The blades 4 are arranged at equal spacings over the entire circumference of the knife cage, which revolves about its central axis, not shown (see the top partial views in FIGS. 1*b* and 2*b*). The blades 4 extending between disks 1 and 2 are inserted into the cage and held in position by means of a lid 6. For cutting a synthetic fiber cable into stable fibers, the cable is wound, in the annular chamber 3, onto the blade crown with several laps so that the respectively innermost lap is cut by contacting the cutting edges of the blades 4 and the staple fibers can be transported away into the interior of the knife cage. For producing the cutting pressure, a fixedly mounted contact roller is provided radially outside of the knife cage; this roller urges the outer lap of the wound-up cable radially inwardly. Since the contact roller is of no importance to the cage construction per se, the roller is omitted from the drawing for the sake of simplicity.

FIG. 2*a* likewise illustrates a knife cage construction wherein, however, two directly superimposed blade crowns or cage sections are provided; for this purpose, another supporting disk 5 is held fixedly in position in the center between the upper blade-supporting disk 1 and the lower blade-supporting disk 2, so that two annular chambers 3' and 3'' are formed. The blades 4, extending over both knife cage sections, are also in this construction inserted in the cage sections from above and held against axial shifting on the topside by means of a lid 6.

The blade-supporting disks 1 and 2, in one embodiment and 1, 2, and 5, in the other embodiment respectively, are held at mutual spacings by means of several partitions 7 uniformly distributed over the circumference. The partitions 7 extend over the height of the knife cage in the radial direction and are joined to the individual blade-supporting disks either by welding, 10, or by firm cementing. A top view of a portion of said partition 7 is illustrated in the drawing; namely in FIGS. 1*b* and 2*b*. It can be seen that these partitions 7 have a breadth which is only slightly larger than the blades 4 arranged radially outwardly. If the partitions 7 are made to be broader than the blades 4, the partitions are fashioned to converge down to the thickness of the blade on each edge of a partition directly adjoining the knife back. As can be seen, each respective partition 7 directly adjoins the associated blade 4. In this way, the feeding of the cut staple fibers into the interior of the knife cage is not only executed uniformly, but also the necessary device for holding the blade-supporting disks 1, 2, 5 at a mutual spacing offers no resistance to the discharge of the staple fibers. The arrangement of the partitions 7 over the circumference of the knife cage is arbitrary. For example, nine such partitions are suitable, uniformly distributed over the circumference. A rugged total construction is obtained, permitting a more lightweight design of the knife cage, by means of the firm connection between the blade-supporting disks by means of the partitions 7, which partition can also be referred to as supporting walls or ribs.

To even further enhance the flow of material during discharging of the staple fibers through the interior of the knife cage, respectively one wall is provided in the center of the knife cage between the partitions 7, this wall extending from the upper blade-supporting disk 1 obliquely inwardly to the lower blade-supporting disk 2. It is suitable to fashion this wall for the knife cage in its entirety of a funnel 8, which is connected along its upper, flaring wall to the upper blade-supporting disk 1, optionally by screws 9, over the entire circumference. The outside wall of this funnel 8 then serves for mounting the partitions 7 distributed over the circumference; for this purpose, these partitions are welded together to the funnel 8 over the entire length. The weld seam 10 can be seen from the drawing. A flow-enhancing annular knife back chamber is thus formed between the outside of the funnel 8 and the lower blade-supporting disk; this annular chamber is subdivided into individual chambers or ducts 11 by the partitions 7.

What is claimed is:

1. An apparatus for cutting ribbon- or cord-like material, especially for the production of staple fibers from synthetic fiber yarns, which comprises a knife cage around which the yarn is wound several times with at least two blade-supporting disks arranged axially one above the other and at a spacing of approximately the knife length by spacer elements provided in a radially inwardly oriented position, and a plurality of knife blades oriented radially outwardly with their cutting edges being held at a spacing corresponding to the desired staple lengths between the disks, the knife cage being adapted to be associated on the outside with a contact roller for obtaining a radially inwardly acting cutting pressure on the wound-up yarns, said spacer elements comprising a plurality of radially oriented partitions that are positioned in the interior of the knife cage and that extend radially inwardly behind the knife blades; said partitions being joined to the blade-supporting disks arranged axially one above the other to provide a stable knife cage; each partition at an edge associated with a knife blade tapering to the thickness of the blade.

2. An apparatus according to claim 1, wherein the partitions directly adjoin associated knife backs that are respectively positioned within one knife cage.

3. An apparatus according to claim 2, wherein the partitions extend at least in part through a staple fiber discharge chamber.

4. An apparatus according to claim 1, wherein the partitions extend at least in part through a staple fiber discharge chamber.

5. An apparatus according to claim 4, wherein the partitions terminate approximately at the level of the underside of the lower blade-supporting disk.

6. An apparatus according to claim 1, wherein the partitions extend at least in part through a staple fiber discharge chamber.

7. An apparatus according to claim 1, wherein the partitions are welded to the upper and to the lower blade-supporting disk.

8. An apparatus according to claim 7, wherein three or more uniformly distributed partitions are arranged over the circumference of the knife cage, and these partitions serve simultaneously as the connecting bearing elements for the superimposed blade-supporting disks.

9. An apparatus according to claim 7, wherein the partitions are joined to the inner peripheral surface of the lower blade-supporting disk and to a staple-fiber-guiding wall by welding.

10. An apparatus according to claim 1 wherein the partitions are joined to an inner peripheral surface of the lower blade-supporting disk and to a staple-fiber-guiding wall by firm cementing.

11. Apparatus according to claim 1 further comprising three blade-supporting disks arranged in superimposed relationship, for the formation of two superimposed knife cages; said partitions extending over the zones of both knife cages.

12. An apparatus for cutting ribbon- or cord-like material, especially for the production of staple fibers from synthetic fiber yarns, which comprises a knife cage around which the yarn is wound several times with at least two blade-supporting disks arranged axially one above the other and at a spacing of approximately the knife length by spacer elements provided in a radially inwardly oriented position, and a plurality of knife blades oriented radially outwardly with their cutting edges being held at a spacing corresponding to the desired staple lengths between the disks, the knife cage being adapted to be associated on the outside with a contact roller for obtaining a radially inwardly acting cutting pressure on the wound-up yarns, said spacer elements comprising a plurality of radially oriented partitions that are positioned in the interior of the knife cage and that extend radially inwardly behind the knife blades; said partitions being joined to the blade-supporting disks arranged axially one above the other to provide a stable knife cage; inner edge portions of the partitions being connected to an inner staple-fiber-guiding wall in the center of the knife cage, said wall being oriented perpendicularly to the partitions.

13. An apparatus for cutting ribbon- or cord-like material, especially for the production of staple fibers from synthetic fiber yarns, which comrpises a knife cage around which the yarn is wound several times with at least two blade-supporting disks arranged axially one above the other and at a spacing of approximately the knife length by spacer elements provided in a radially inwardly oriented position, and a plurality of knife blades oriented radially outwardly with their cutting edges being held at a spacing corresponding to the desired staple lengths between the disks, the knife cage being adapted to be associated on the outside with a contact roller for obtaining a radially inwardly acting cutting pressure on the wound-up yarns, said spacer elements comprising a plurality of radially oriented partitions that are positioned in the interior of the knife cage and that extend radially inwardly behind the knife blades; said partitions being joined to the blade-supporting disks arranged axially one above the other to provide a stable knife cage, the partitions being welded to the upper and to the lower blade-supporting disks, with three or more uniformly distributed partitions being arranged over the circumference of the knife cage and these partitions serving simultaneously as the connecting bearing elements for the superimposed blade-supporting disks and a cylinder-like displacement member, arranged in the center of the knife cage, said cylinder-like member being joined to the partitions and defining an annular knife back chamber within the knife cage in conjunction with an inner peripheral surface of the lower blade-supporting disk; said partitions extending transversely through said annular chamber.

14. An apparatus according to claim 13, wherein the cylinder flares radially at the top and constitutes a funnel.

15. An apparatus according to claim 14, wherein the flaring upper wall of the funnel is firmly connected to the upper blade-supporting disk.

* * * * *